US011346011B2

(12) United States Patent
Kusuhara et al.

(10) Patent No.: US 11,346,011 B2
(45) Date of Patent: May 31, 2022

(54) METHOD FOR PREVENTING CORROSION OF CABLE

(71) Applicant: Honshu-Shikoku Bridge Expressway Company Limited, Kobe (JP)

(72) Inventors: Shigeki Kusuhara, Hyogo (JP); Masao Kume, Hyogo (JP); Akira Machida, Hyogo (JP)

(73) Assignee: Honshu-Shikoku Bridge Expressway Company Limited, Kobe (JP)

( * ) Notice: Subject to any disclaimer, the term of this patent is extended or adjusted under 35 U.S.C. 154(b) by 867 days.

(21) Appl. No.: 16/193,190

(22) Filed: Nov. 16, 2018

(65) Prior Publication Data

US 2019/0161867 A1 May 30, 2019

(30) Foreign Application Priority Data

Nov. 24, 2017 (JP) ..... JP2017-225495

(51) Int. Cl.
*C23F 15/00* (2006.01)
*C23F 11/00* (2006.01)

(52) U.S. Cl.
CPC ..... *C23F 15/00* (2013.01); *C23F 11/00* (2013.01)

(58) Field of Classification Search
CPC ..... C23F 15/00
See application file for complete search history.

(56) References Cited

U.S. PATENT DOCUMENTS

2010/0293728 A1 11/2010 Yamane et al.
2018/0054916 A1 2/2018 Kosugi et al.

FOREIGN PATENT DOCUMENTS

| | | | |
|---|---|---|---|
| JP | H08-177012 | A | 7/1996 |
| JP | H10-159019 | A | 6/1998 |
| JP | 2003-056121 | A | 2/2003 |
| JP | 2009-108604 | A | 5/2009 |
| JP | 6194993 | B1 | 9/2017 |
| JP | 2018-028750 | A | 2/2018 |

OTHER PUBLICATIONS

English machine translation of JP H10159019A (Year: 1998).*
Office Action of JP corresponding application No. 2017-225495 dated Dec. 3, 2019 and partial English translation thereof.

* cited by examiner

*Primary Examiner* — Peter F Godenschwager
(74) *Attorney, Agent, or Firm* — Muncy, Geissler, Olds & Lowe, P.C.

(57) ABSTRACT

Provided is a method for preventing corrosion of a cable including a plurality of bundled wires and a covering tube which covers the plurality of wires, the method including a mixed gas generation step of mixing a low-oxygen gas having an oxygen concentration lower than an oxygen concentration of air with the air, and a mixed gas supply step of supplying the mixed gas into the covering tube to flow the mixed gas around each of the wires.

6 Claims, 12 Drawing Sheets

METHOD FOR PREVENTING CORROSION OF CABLE

BACKGROUND OF THE INVENTION

Technical Field

The present invention relates to a method for preventing corrosion of a cable for use in bridges, specifically, a method for preventing corrosion of a cable including a plurality of bundled wires and a covering tube which covers the plurality of wires.

Background Art

As a bridge passed over straits, rivers and the like, there has been known a bridge including a main cable and a bridge girder suspended from the main cable via hanger ropes. Such a bridge, being exposed to wind and rain and direct sunlight, is likely to be influenced by an environment in which the bridge is disposed (specifically, influenced by change of seasons or change of weather). Hence, the use of bridges for a long period of time requires various measures.

For example, Unexamined Japanese Patent Publication Nos. H8-177012 and H10-159019 disclose methods for preventing corrosion of a main cable including a plurality of bundled wires and a covering tube which covers the wires. These methods involves supplying dry air into the covering tube to flow the dry air between the wires to thereby protect them from corrosion.

However, it has been found that simply flowing dry air between wires is not sufficient to suppress corrosion of the plurality of wires.

SUMMARY OF INVENTION

An object of the present invention is to provide a method capable of suppressing corrosion of a plurality of wires forming a cable.

In order to achieve the object, the inventor of the present application has focused on a relationship between a corrosion progress speed of a wire and an oxygen concentration of air existing around the wires, thereby having attained the knowledge that flowing a gas with an oxygen concentration lower than that of air between the plurality of wires to allow the plurality of wires to exist under an atmosphere with an oxygen concentration lower than that of air makes it possible to suppress corrosion of the wires.

Meanwhile, an excessively low oxygen concentration affects workers who conduct maintenance of bridges. Besides, generating such a gas involves increased costs. It is necessary not only to simply reduce an oxygen concentration but also to take the above circumstances into consideration.

Provided is a method for preventing corrosion of a cable including a plurality of bundled wires and a covering tube which covers the plurality of wires, the method including: a step of mixing a low-oxygen gas with an air, the low-oxygen gas having an oxygen concentration lower than an oxygen concentration of the air, to thereby generate a mixed gas; and a step of supplying the generated mixed gas into the covering tube to flow the mixed gas around each of the wires.

DESCRIPTION OF EMBODIMENTS

In the following, embodiments of the present invention will be described in detail with reference to the accompanying drawings.

Figure 1:
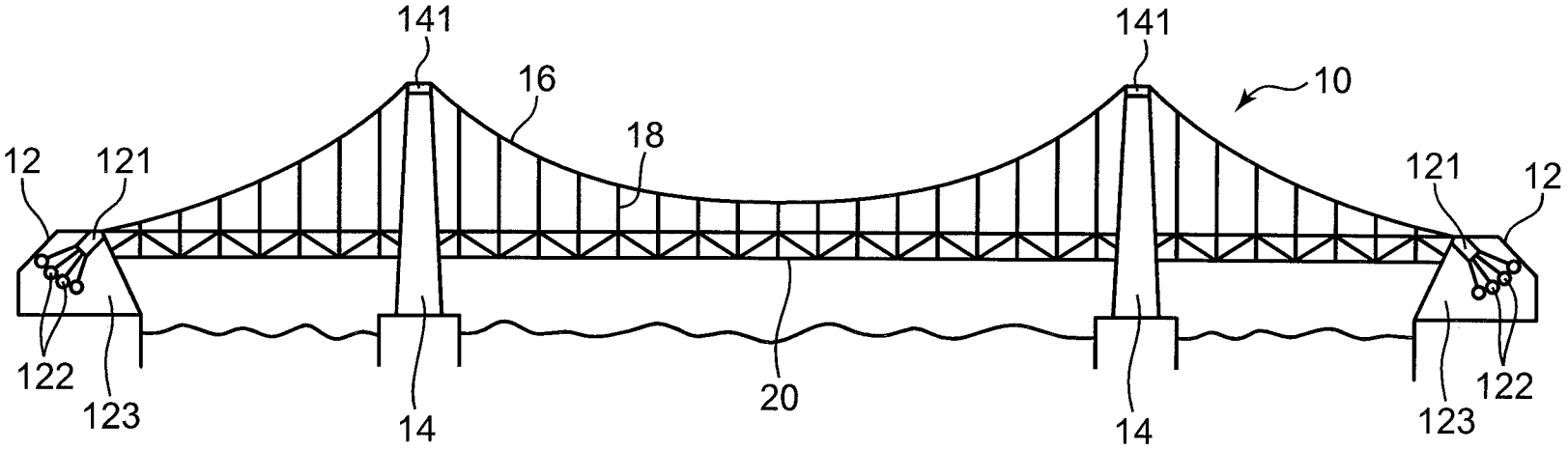
FIG. 1 is a side view showing a bridge including cables to be prevented from corroding through a method for preventing corrosion of a cable according to a first embodiment of the present invention.

With reference to FIG. 1, description will be made of an example of a bridge including a cable as a target of a corrosion prevention method according to a first embodiment of the present invention. FIG. 1 is a side view showing a bridge 10 which is an example of the bridge. The bridge 10 includes a pair of abutments 12, a plurality of main towers 14, a plurality of cables 16, a plurality of hanger ropes 18, and a bridge girder 20, the cable 16 corresponding to the cable to be prevented from corroding through the method for preventing corrosion of a cable according to the first embodiment of the present invention.

The pair of the abutments 12 are provided to opposite banks of strait, river or the like, respectively. The plurality of main towers 14 are aligned between the pair of the abutments 12. The plurality of cables 16 are stretched between a pair of spray saddles 121 provided to the pair of abutments 12, respectively, via a plurality of vertex saddles 141 provided to respective main towers 14, wherein opposite ends of the cable 16 are fixed to respective fixing portions 122 provided in the pair of the abutments 12. The plurality of hanger ropes 18 are suspended from the cables 16 at a predetermined interval to support the bridge girder 20. Each of the pair of abutments 12 is provided with a workroom 123 internally, the workroom 123 allowing a worker to enter the workroom 123 to conduct maintenance of the bridge 10.

Figure 2:
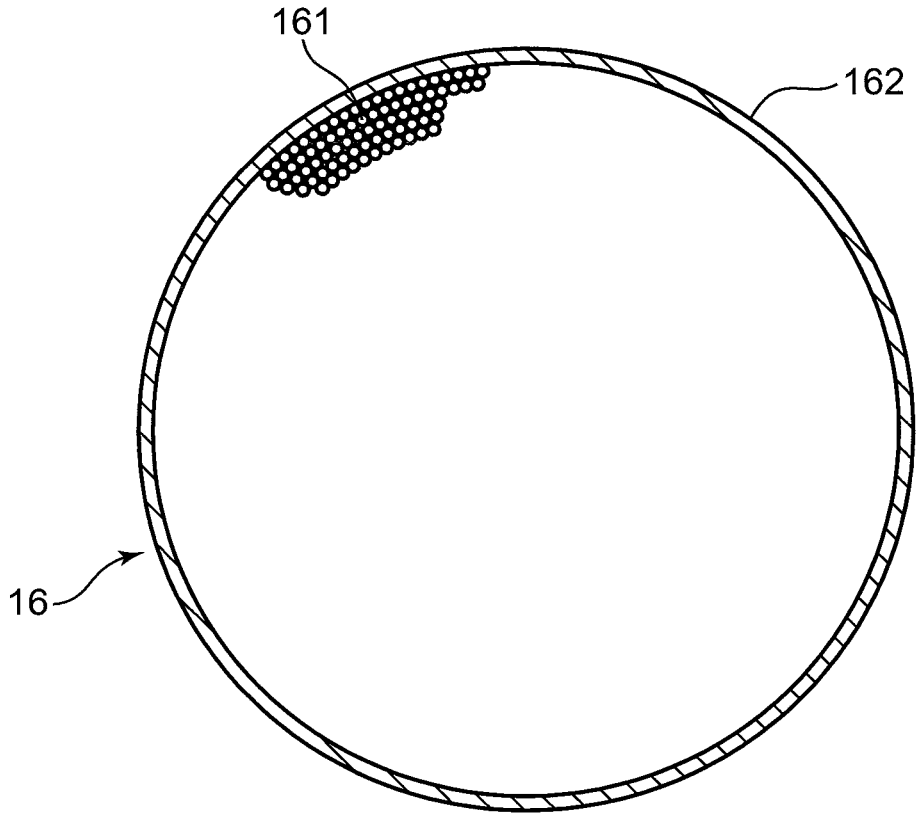
FIG. 2 is a sectional view of the cable shown in FIG. 1.

With reference to FIG. 2, each component of the cable 16 will be described. FIG. 2 is a sectional view of the cable 16.

The cable 16 includes a plurality of bundled wires 161 and a covering tube 162 which covers the plurality of wires 161. Each of the wires 161 is a metal wire plated with zinc. The covering tube 162 includes, for example, an anticorrosion tape or a wrapping wire wound around each of the wires 161.

The covering tube 162 has opposite ends in a direction along which the covering tube 162 extends, the opposite ends being opened in the workrooms 123 in the pair of abutments 12, respectively. This allows at least a part of a mixed gas to be discharged into the workrooms 123 after being supplied into the cable 16 and flowed around each of the wires 161 as described later.

Figure 3:
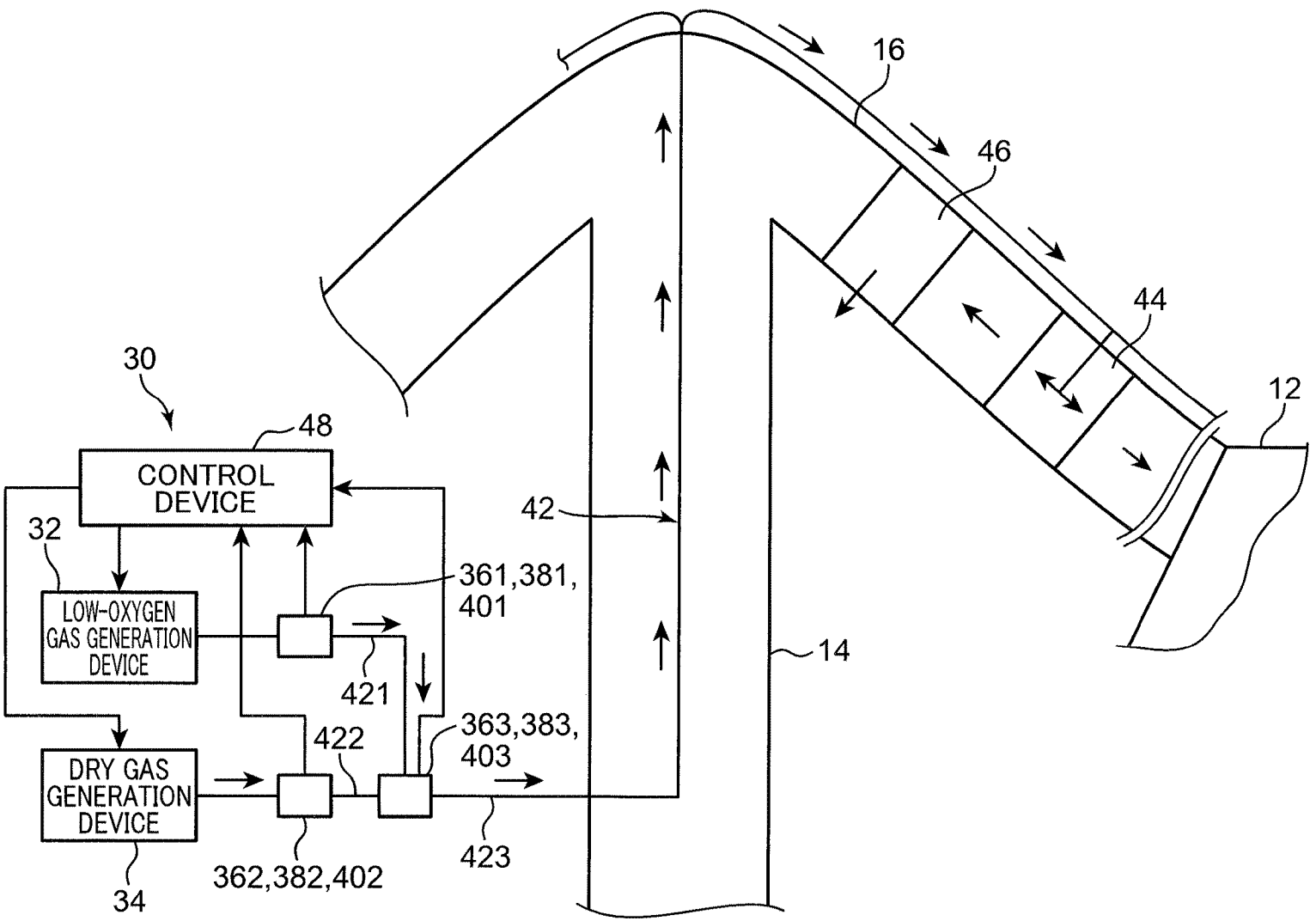
FIG. 3 is a schematic view showing a schematic configuration of a corrosion prevention apparatus for preventing corrosion of the cable shown in FIG. 1.

FIG. 3 is a schematic view of a corrosion prevention apparatus 30. The corrosion prevention apparatus 30 is an apparatus for suppressing corrosion of the plurality of wires 161 forming the cable 16.

The corrosion prevention apparatus 30 includes a low-oxygen gas generation device 32, a dry gas generation device 34, a low-oxygen gas temperature sensor 361, a dry gas temperature sensor 362, a mixed gas temperature sensor 363, a low-oxygen gas humidity sensor 381, a dry gas humidity sensor 382, a mixed gas humidity sensor 383, a low-oxygen gas oxygen concentration sensor 401, a dry gas oxygen concentration sensor 402, a mixed gas oxygen concentration sensor 403, a piping 42, a plurality of air supply covers 44, a plurality of exhaust covers 46, and a control device 48. These components are described below.

The low-oxygen gas generation device 32 generates a low-oxygen gas having an oxygen concentration lower than that of air. The low-oxygen gas generation device 32 includes, for example, a nitrogen gas producing device which produces a nitrogen gas as a low-oxygen gas, a blower as an air supply device which sends a nitrogen gas, and a valve for regulating a flow rate of a nitrogen gas. The nitrogen gas producing device produces a nitrogen gas by using, for example, a membrane separation method. The low-oxygen gas may be, for example, a mixture of a nitrogen gas and air.

The dry gas generation device 34 generates dry air as a dry gas. The dry gas generation device 34 includes, for example, a dry humidifying machine using a silica gel rotor, a blower as an air supply device which sends out dry air, and a valve for regulating a flow rate of dry air.

The low-oxygen gas temperature sensor 361 detects a temperature of the low-oxygen gas. The low-oxygen gas temperature sensor 361 generates a signal with respect to the detected temperature of the low-oxygen gas, and input the signal to the control device 48. The low-oxygen gas temperature sensor 361 is provided midway in a first piping 421 to be described later.

The dry gas temperature sensor 362 detects a temperature of dry air. The dry gas temperature sensor 362 generates a signal with respect to the detected temperature of the dry air, and inputs the signal to the control device 48. The dry gas temperature sensor 362 is provided midway in a second piping 422 described below.

The mixed gas temperature sensor 363 detects a temperature of a mixed gas generated by mixing a low-oxygen gas with dry air. The mixed gas temperature sensor 363 generates a signal with respect to the detected temperature of the mixed gas and inputs the signal to the control device 48. The mixed gas temperature sensor 363 is provided to a merging portion where the first piping 421, the second piping 422, and a third piping 423, which are described later, are merged with each other.

The low-oxygen gas humidity sensor 381 detects a relative humidity of the low-oxygen gas. The low-oxygen gas humidity sensor 381 generates a signal with respect to the detected relative humidity of the low-oxygen gas, and inputs the signal to the control device 48. The low-oxygen gas humidity sensor 381 is provided midway in the first piping 421 to be described later.

The dry gas humidity sensor 382 detects a relative humidity of dry air. The dry gas humidity sensor 382 generates a signal with respect to the detected relative humidity of the dry air, and inputs the signal to the control device 48. The dry gas humidity sensor 382 is provided midway in the second piping 422 to be described later.

The mixed gas humidity sensor 383 detects a relative humidity of the mixed gas generated by mixing a low-oxygen gas with dry air. The mixed gas humidity sensor 383 generates a signal with respect to the detected relative humidity of the mixed gas, and inputs the signal to the control device 48. The mixed gas humidity sensor 383 is provided in a merging portion where the first piping 421, the second piping 422, and the third piping 423 to be described later merge with each other.

The low-oxygen gas oxygen concentration sensor 401 detects an oxygen concentration of the low-oxygen gas. The low-oxygen gas oxygen concentration sensor 401 generates a signal with respect to the detected oxygen concentration of the low-oxygen gas, and inputs the signal to the control device 48. The low-oxygen gas oxygen concentration sensor 401 is provided midway in the first piping 421 to be described later.

The dry gas oxygen concentration sensor 402 detects an oxygen concentration of the dry air. The dry gas oxygen concentration sensor 402 generates a signal with respect to the detected oxygen concentration of the dry air, and inputs the signal to the control device 48. The dry gas oxygen concentration sensor 402 is provided midway in the second piping 422 to be described later.

The mixed gas oxygen concentration sensor 403 detects an oxygen concentration of the mixed gas generated by mixing a low-oxygen gas with dry air. The mixed gas oxygen concentration sensor 403 generates a signal with respect to the detected oxygen concentration of the mixed gas, and inputs the signal to the control device 48. The mixed gas oxygen concentration sensor 403 is provided in the merging portion of the first piping 421, the second piping 422, and the third piping 423.

The piping 42 is arranged so as to be capable of generating a mixed gas by mixing a low-oxygen gas with dry air, and supplying the mixed gas into the cable 16 via each of the air supply covers 44. The piping 42 includes the first piping 421, the second piping 422, and the third piping 423.

In the first piping 421 flows low-oxygen gas. The first piping 421 is connected to the low-oxygen gas generation device 32.

In the second piping 422 flows dry air. The second piping 422 is connected to the dry gas generation device 34.

In the third piping 423 flows a mixed gas. The third piping 423 has upstream ends, which are connected to respective downstream ends of the first piping 421 and the second piping 422. In the merging portion of the first piping 421, the second piping 422, and the third piping 423, a low-oxygen gas and dry air are mixed to generate a mixed gas.

The third piping 423 includes a first portion disposed in the main tower 14 and a second portion disposed along the cables 16 downstream of the first portion.

The plurality of air supply covers 44 are arranged so as to guide a mixed gas flowing in the piping 42 (specifically, the third piping 423) to the cable 16. The plurality of air supply covers 44 are each mounted on the cable 16. The plurality of air supply covers 44 are arranged at an appropriate interval in an extension direction of the cable 16. The plurality of air supply covers 44 are connected with respective branch tubes branching from the piping 42 and a mixed gas flowing through the piping 42 (specifically, the third piping 423) is introduced into the air supply covers 44 through the branch tubes.

The plurality of exhaust covers 46 are arranged so as to allow a mixed gas supplied from each of the air supply covers 44 into the cable 16 to be discharged to the outside the cable 16 through the plurality of exhaust covers 46. Specifically, each of the exhaust covers 46 is provided with an exhaust port 461, through which a mixed gas flowing in the cable 16 is discharged to the outside. The plurality of exhaust covers 46 are mounted on the cable 16. The plurality of exhaust covers 46 are arranged at an appropriate interval in the extension direction of the cable 16.

Figure 4:
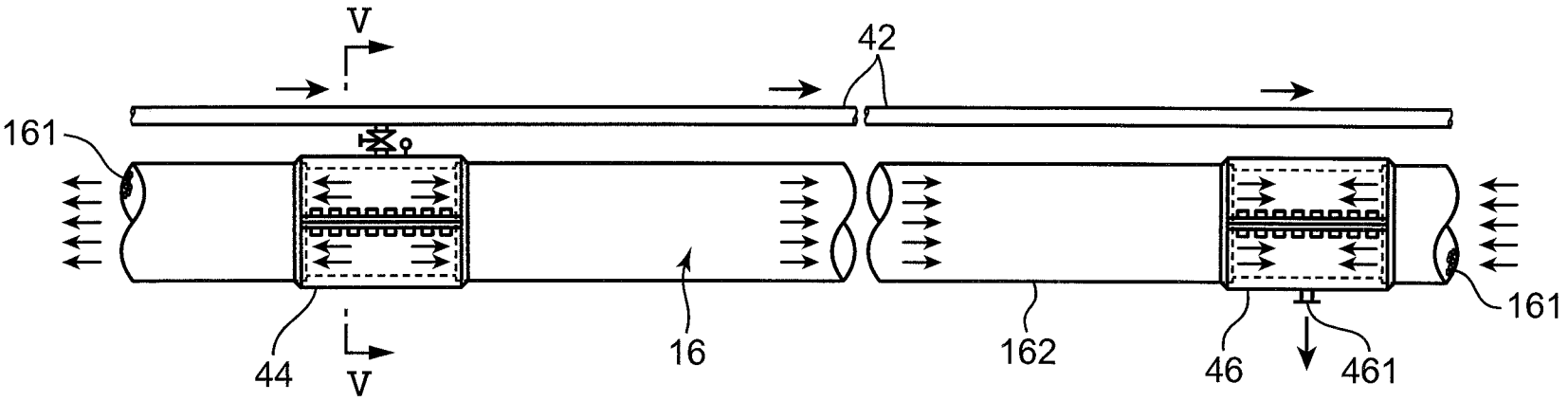
FIG. 4 is an enlarged side view showing a part of the cable shown in FIG. 1.

With reference to FIG. 4, the air supply cover 44 and the exhaust cover 46 will be described. FIG. 4 is an enlarged side view showing a part of the cable 16.

Each of the air supply covers 44 and the exhaust covers 46 is formed of a pair of semi-cylindrical members joined with each other to have a tubular entire shape. The air supply covers 44 and the exhaust covers 46 are alternately aligned in the extension direction of the cable 16. The covering tube 162 is interposed between the air supply cover 44 and the exhaust cover 46 adjacent to each other. A connection portion between the air supply cover 44 and the covering tube 162 and a connection portion between the exhaust cover 46 and the covering tube 162 are sealed by sealing members.

Figure 5:
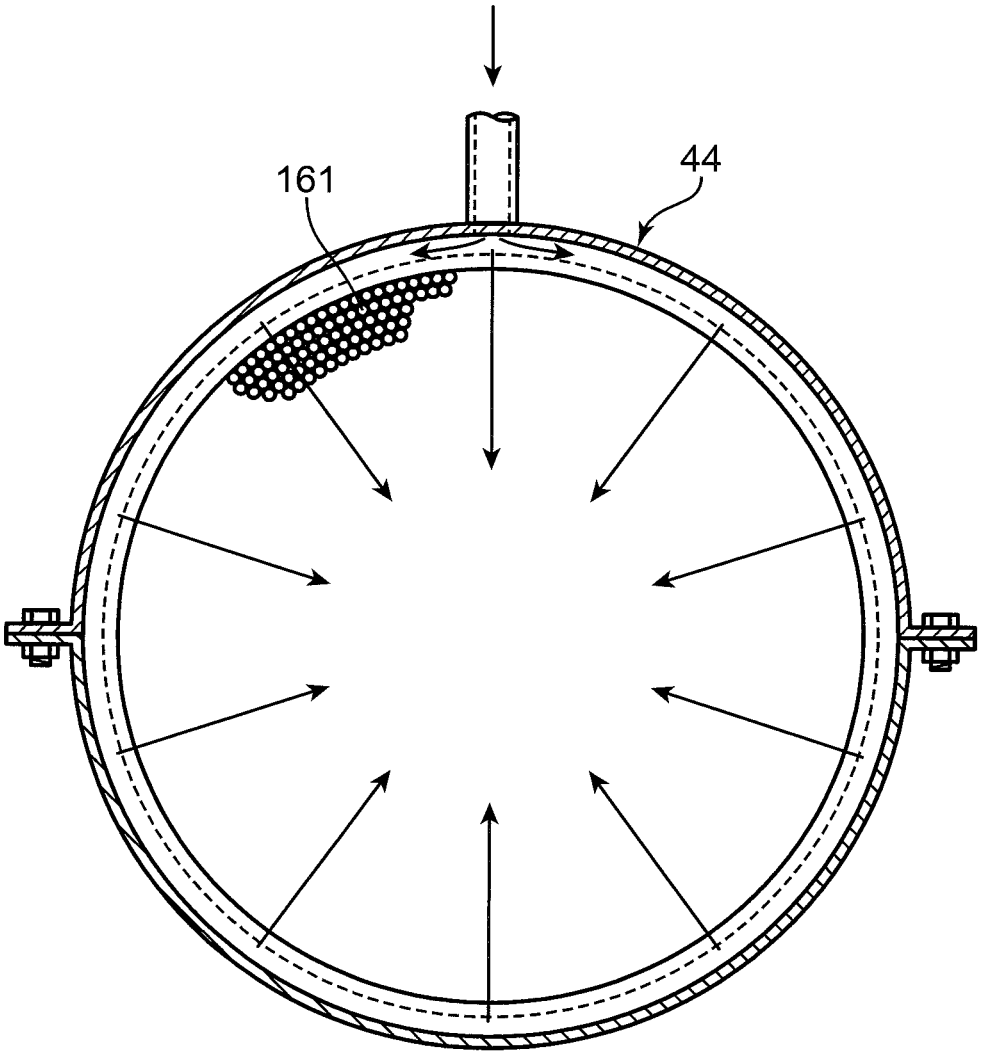
FIG. 5 is a view showing a section taken along line V-V in FIG. 4.

With reference to FIG. 5, the inside of the air supply cover 44 will be described. FIG. 5 shows a section taken along line V-V in FIG. 4.

Figure 6:
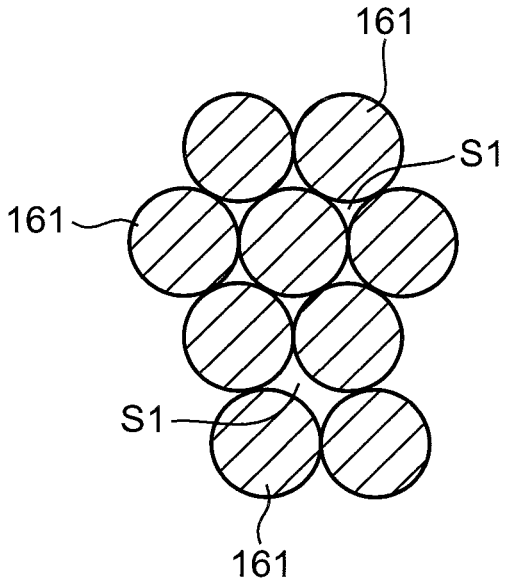
FIG. 6 is a sectional view showing gaps formed between a plurality of wires forming the cable shown in FIG. 1.

The covering tube 162 is absent inside the air supply covers 44. In other words, the plurality of wires 161 are covered with the air supply cover 44. There is formed a gap S1 between the plurality of wires 161 as shown in FIG. 6. A mixed gas sent into the air supply cover 44 through the piping 42 passes through the gap S1 formed between the plurality of wires 161 to flow in the cable 16.

Although not graphically shown, the covering tube 162 is absent also inside the exhaust cover 46. In other words, the plurality of wires 161 are covered with the exhaust covers 46.

The control device 48 adjusts respective flow rates of a low-oxygen gas and dry air to control an oxygen concentration and a relative humidity of a mixed gas. Specifically, the control device 48 controls respective operations of the low-oxygen gas generation device 32 and the dry gas generation device 34 so as to maintain each of the oxygen concentration and the relative humidity of the mixed gas within an appropriate range (an appropriate range PA1 shown in FIG. 8).

The control device 48 has, for example, a storage device which stores a program, and a central processing unit which reads the program to conduct predetermined processing. At least a part of the control device 48 can be formed by an integrated circuit such as ASIC or the like.

Figure 7:
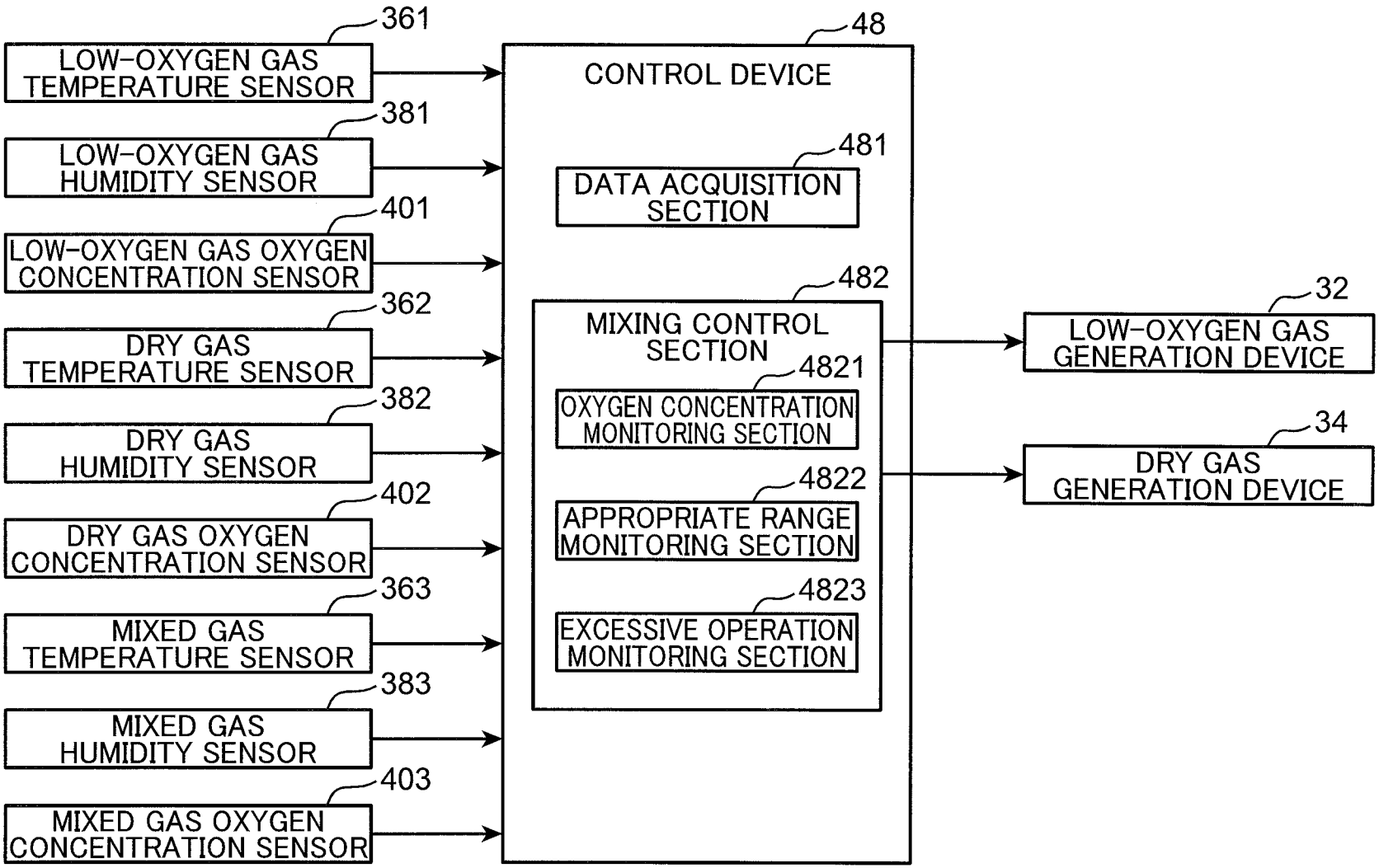
FIG. 7 is a block diagram showing a function of a control device configuring the corrosion prevention apparatus.

With reference to FIG. 7, the control device 48 will be described. FIG. 7 is a block diagram showing a functional configuration of the control device 48.

The control device 48 includes a data acquisition section 481 and a mixing control section 482. These components will be described in the following.

The data acquisition section 481 acquires respective temperatures detected by the temperature sensors 361, 362, and 363, respective relative humidities detected by the humidity sensors 381, 382, and 383, respectively, and respective oxygen concentrations detected by the oxygen concentration sensors 401, 402, and 403.

Figure 8:
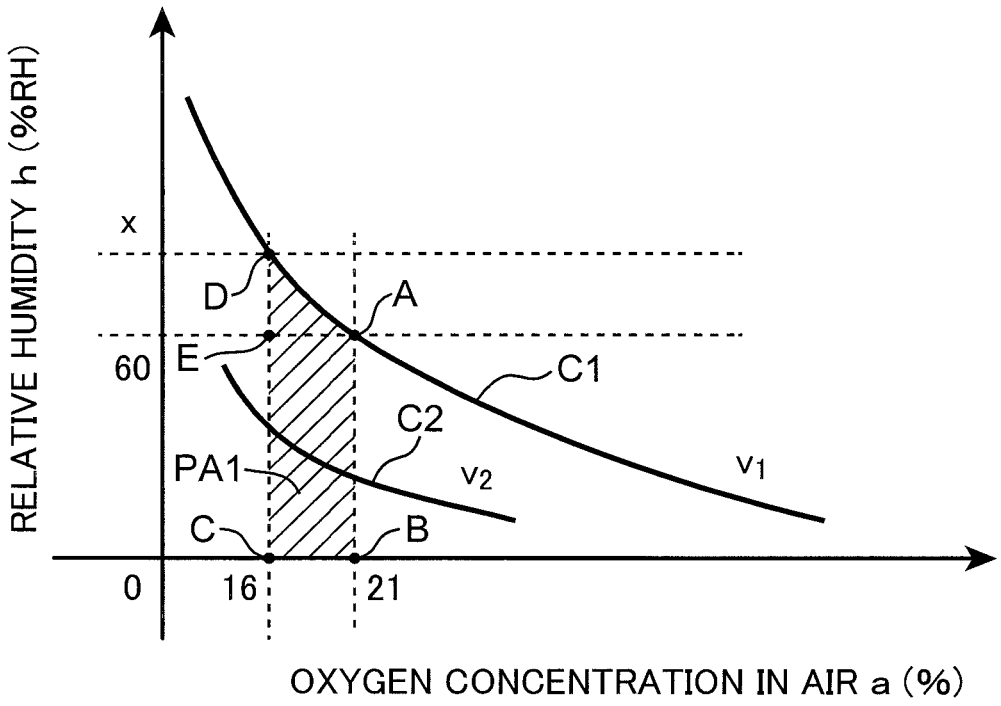
FIG. 8 is a graph showing an appropriate range of an oxygen concentration and a relative humidity of a mixed gas.

The mixing control section 482 controls respective operations of the low-oxygen gas generation device 32 and the dry gas generation device 34 so as to maintain each of the oxygen concentration and the relative humidity of the mixed gas within an appropriate range (the appropriate range PA1 shown in FIG. 8).

Let the flow rate of a low-oxygen gas be $F_1$, the flow rate of dry air be $F_2$, and the flow rate of a mixed gas be $F_0$, then the relationship expressed by Formula (1) below is established.

$$F_0=F_1+F_2 \tag{1}$$

Let the temperature of a low-oxygen gas be $T_1$, the temperature of dry air be $T_2$, and the temperature of a mixed be $T_0$, then, the relationship indicated by Formula (2) is established if assuming that each gas has the same specific heat and a volume of each gas will not change with a temperature.

$$F_0T_0=F_1T_1+F_2T_2 \tag{2}$$

Let the oxygen concentration of a low-oxygen gas be $a_1$, the oxygen concentration of dry air be $a_2$, and the oxygen concentration of a mixed gas be $a_0$, then, the relationship expressed by Formula (3) below is established.

$$F_0a_0=F_1a_1+F_2a_2 \tag{3}$$

Let the saturated vapor pressure of a low-oxygen gas be $P(T_1)$, the saturated vapor pressure of dry air be $P(T_2)$, the saturated vapor pressure of a mixed gas be $P(T_0)$, the relative humidity of the low-oxygen gas be $h_1$, the relative humidity of the dry air be $h_2$, and the relative humidity of the mixed gas be $h_0$, then, the relationship expressed by Formula (4) below is established.

$$F_0\frac{P(T_0)h_0}{P_0}=F_1\frac{P(T_1)h_1}{P_0}+F_2\frac{P(T_2)h_2}{P_0} \tag{4}$$

$P_0$ in Formula (4) represents an atmospheric pressure (101.3 kPa). The saturated vapor pressure P(T) is expressed as a function of a temperature as expressed by Formula (5) below.

$$P(T)=0.611\times10^{\alpha} \tag{5}$$

wherein $\alpha=7.5\ T/(T+237)$.

In order to maintain each of the oxygen concentration and the relative humidity of the mixed gas within an appropriate range (the appropriate range PA1 shown in FIG. 8), the mixing control section 482 controls respective operations of the low-oxygen gas generation device 32 and the dry gas generation device 34 so as to adjust each flow rate of the low-oxygen gas and the dry air based on Formulas (1) to (5). In the present embodiment, respective adjustments of the flow rate of the low-oxygen gas and the dry air are conducted so as to make the flow rate of the mixed gas be constant.

The mixing control section 482 includes an oxygen concentration monitoring section 4821, an appropriate range monitoring section 4822, and an excessive operation monitoring section 4823. These components will be described in the following.

The oxygen concentration monitoring section 4821 monitors whether or not the oxygen concentration of a mixed gas acquired by the data acquisition section 481 is within a predetermined range.

The range of the oxygen concentration of the mixed gas is determined in consideration with influence on a human body. In the present embodiment, the range of the oxygen concentration of the mixed gas is set to be 16% to 21%. The lower limit value of the oxygen concentration of the mixed gas is not limited to 16%. For example, if a worker conducts works using an oxygen cylinder, the oxygen concentration of the mixed gas is allowed to be lower than 16%.

The appropriate range monitoring section 4822 monitors whether or not the oxygen concentration and the relative humidity of the mixed gas acquired by the data acquisition section 481 are within the predetermined appropriate range PA1 (see FIG. 8). The appropriate range PA1 is a range in which there exist combinations of a suitable oxygen concentration and a suitable relative humidity of a mixed gas for delaying progress of corrosion of the plurality of wires 161.

The appropriate range PA1 will be described with reference to FIG. 8, which is a graph for explaining the appropriate range PAL At the point A shown in FIG. 8, the oxygen concentration is 21% and the relative humidity is 60% RH. The oxygen concentration and the relative humidity at the point A show the corrosion limit state of steel material. Let the corrosion progress speed of the steel material in the corrosion limit state be $v_1$. The relationship between the oxygen concentration and the relative humidity to make a corrosion progress speed be $v_1$ is expressed by a curved line C1. The oxygen concentration and the relative humidity below the curved line C1, therefore, enables progress of corrosion to be delayed. Meanwhile, the oxygen concentration less than 16% exerts a large influence upon a human body. For the reason, the allowable range of the oxygen concentration is set to be 16% to 21%. Specifically, the appropriate range PA1 is a region surrounded by the point A, the point B which indicates the position where the oxygen concentration is 21% on the horizontal axis, the point C which indicates the position where the oxygen concentration is 16% on the horizontal axis, and the point D which indicates the position where the oxygen concentration is 16% on the curved line C1, the region being indicated by slanting lines in FIG. 8. Moreover, the region surrounded by the point A, the point D, and the point E at which the combination of the relative humidity at the point A and the oxygen concentration at the point D (or the point C) exists is a region in which progress of corrosion of the plurality of wires 161 can be suppressed even when the relative humidity is 60% RH or more in the appropriate range PAL The excessive operation monitoring section 4823 shown in FIG. 7 monitors whether or not the low-oxygen gas generation device 32 and the dry gas generation device 34 are in excessive operation, based on the oxygen concentration and the relative humidity of a mixed gas acquired by the data acquisition section 481.

With reference to FIG. 8, description will be made of a criterion to judge whether or not the low-oxygen gas generation device 32 and the dry gas generation device 34 are in excessive operation. FIG. 8 shows a curved line C2 which indicates a relationship between the oxygen concentration and the relative humidity to make the corrosion progress speed be a speed $v_2$ lower than the speed $v_1$. In the present embodiment, when the oxygen concentration and the relative humidity are under the curved line C2, the low-oxygen gas generation device 32 and the dry gas generation device 34 are judged as being in excessive operation. The corrosion progress speed $v_2$ is set according to, for example, the gas generation capacity of at least one of the low-oxygen gas generation device 32 and the dry gas generation device 34.

Figure 9:
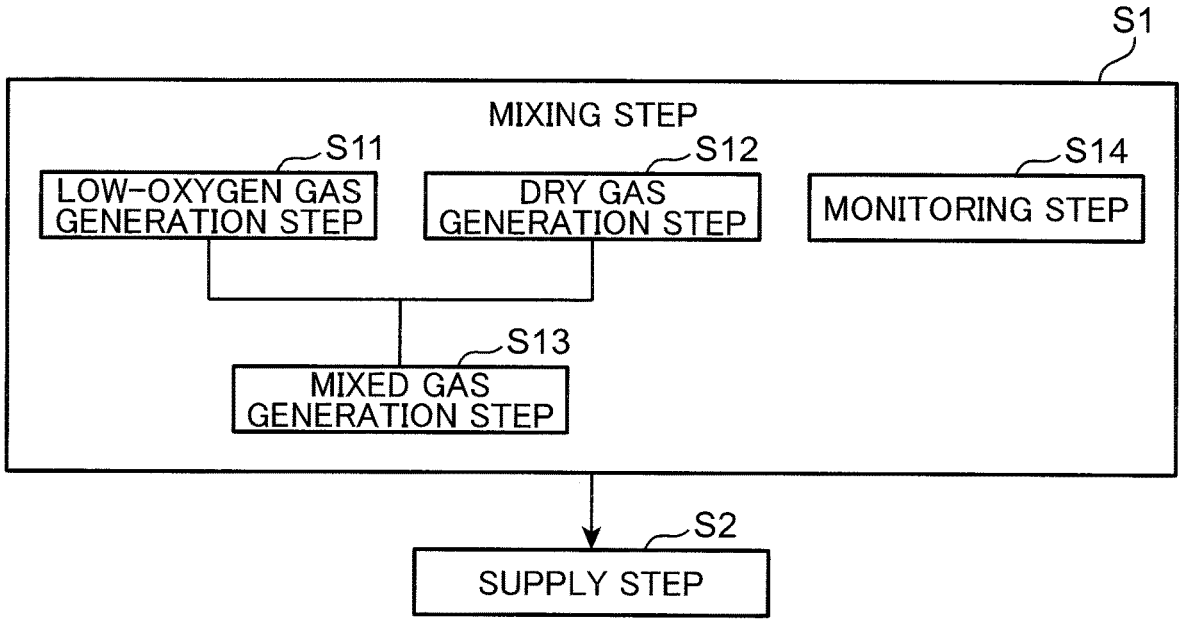
FIG. 9 is a flow chart showing the corrosion prevention method.

With reference to FIG. 9, description will be made of a corrosion prevention method for preventing corrosion of the cable 16. FIG. 9 is a flow chart showing the corrosion prevention method.

The corrosion prevention method includes a mixing step (Step S1) and a supply step (Step S2). In the following, these steps will be described. In the present embodiment, the mixing step and the supply step are executed in this order due to the configuration of the corrosion prevention apparatus 30.

In the mixing step, a mixed gas is generated by mixing a low-oxygen gas with dry air. The mixing step includes a low-oxygen gas generation step (Step S11), a dry gas generation step (Step S12), a mixed gas generation step (Step S13), and a monitoring step (Step S14).

The low-oxygen gas generation step is a step of generating a low-oxygen gas through the low-oxygen gas generation device 32.

The dry gas generation step is a step of generating dry air through the dry gas generation device 34.

The mixed gas generation step is a step of mixing the low-oxygen gas generated in the low-oxygen gas generation step with the dry gas generated in the dry gas generation step to thereby generate a mixed gas.

The monitoring step is a step of controlling respective operation states of the low-oxygen gas generation device 32 and the dry gas generation device 34 so as to maintain the oxygen concentration and the relative humidity of the mixed gas within the appropriate range PAL The supply step is a step of supplying the mixed gas generated in the mixing step into the cable 16.

Figure 10:
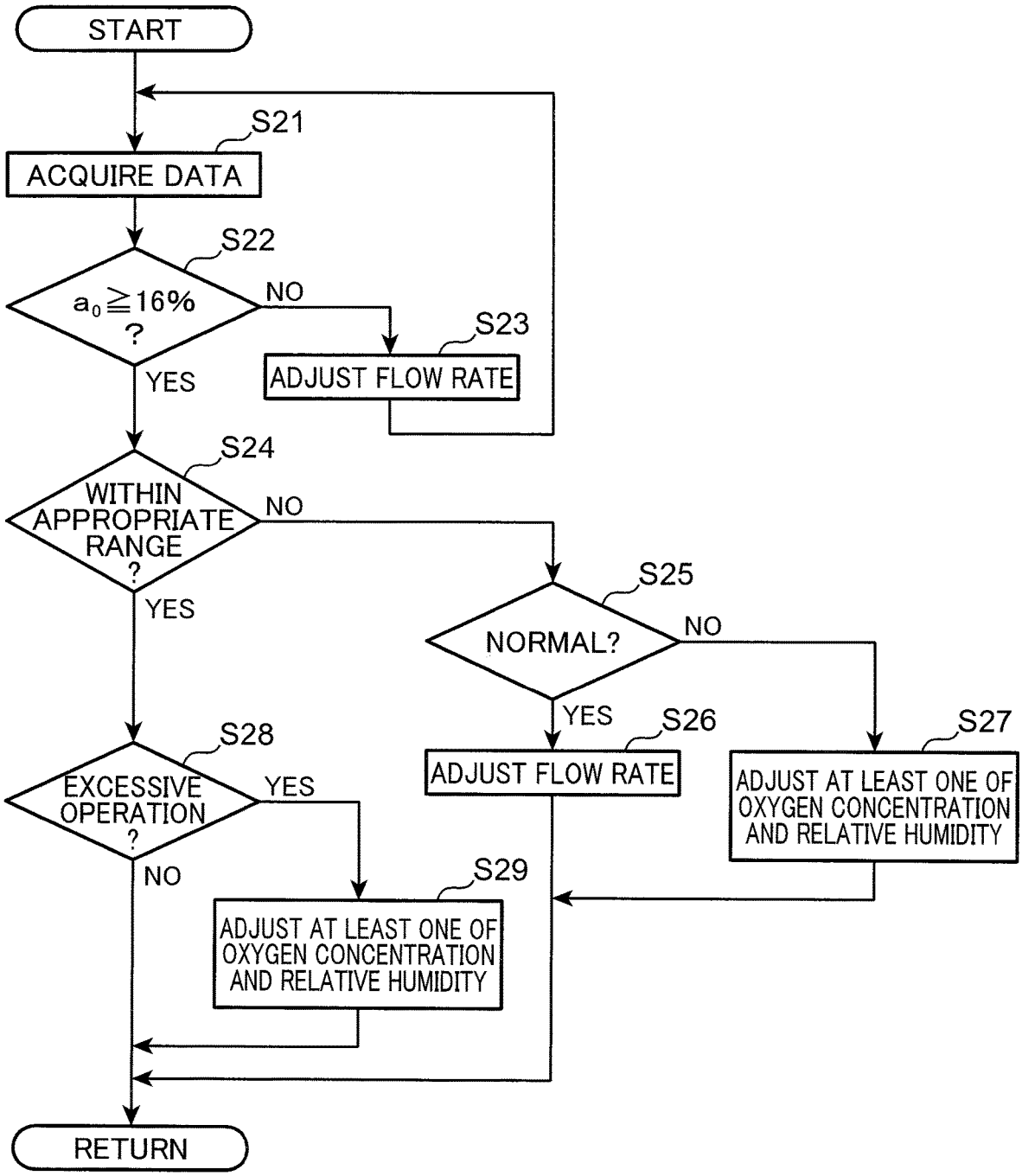
FIG. 10 is a flow chart showing a monitoring step in the corrosion prevention method.

Details of the monitoring step will be described with reference to FIG. 10, which is a flow chart showing the monitoring step. The monitoring step is executed by the control device 48.

The control device 48 first acquires data of a low-oxygen gas, dry air, and a mixed gas (data with respect to a temperature, a relative humidity, and an oxygen concentration) in Step S21. The acquired data is stored in, for example, a not-graphically-shown storage device.

Subsequently, the control device 48 judges in Step S22 whether or not the oxygen concentration $a_0$ of the mixed gas is 16% or more.

In the case where the oxygen concentration $a_0$ of the mixed gas is less than 16% (NO in Step S22), the control device 48 adjusts respective flow rates of the low-oxygen gas and the dry air in Step S23. The flow rates of the low-oxygen gas and the dry air are calculated with use of Formulas (1) and (3) under setting the oxygen concentration $a_0$ of the mixed gas to an appropriate value (target value) of 16% or more. Following the completion of the adjustment of the flow rates, the control device 48 executes the processing in Step S21 and the steps thereafter.

In the case where the oxygen concentration $a_0$ of the mixed gas is 16% or more (YES in Step S22), the control device 48 judges in Step S24 whether or not the oxygen concentration and the relative humidity of the mixed gas acquired in Step S21 are present within the appropriate range PAL In the case where the oxygen concentration and the relative humidity of the mixed gas acquired in Step S21 are absent within the appropriate range PA1 (NO in Step S24), the control device 48 judges in Step S25 whether or not the operation is in a normal state. Specifically, the control device 48 judges whether or not the vapor pressure of the mixed gas is present between the vapor pressure of the low-oxygen gas and the vapor pressure of the dry air. In short, the control device 48 judges whether or not one of the following Formula (6) and Formula (7) is established.

$$P(T_1)h_1<P(T_0)h_0<P(T_2)h_2 \quad (6)$$

$$P(T_1)h_1>P(T_0)h_0>P(T_2)h_2 \quad (7)$$

When the low-oxygen gas generation device 32 and the dry gas generation device 34 are operated normally (YES in Step S25), the control device 48 adjusts the flow rates of the low-oxygen gas and the dry air in Step S26. The flow rates of the low-oxygen gas and the dry air are calculated with use of the Formulas (1), (2), and (4) under setting the relative humidity $h_0$ of the mixed gas to an appropriate value (target value). Following the completion of the adjustment of the flow rates, the control device 48 executes the processing in Step S21 and the steps thereafter.

When the low-oxygen gas generation device 32 and the dry gas generation device 34 are not normally operated (NO in Step S25), the control device 48 lowers, in Step S27, at least one of the oxygen concentration $a_1$ of the low-oxygen gas generated by the low-oxygen gas generation device 32 and the relative humidity $h_2$ of the dry air generated by the dry gas generation device 34. In the case of producing a low-oxygen gas by mixing a nitrogen gas with air, lowering the oxygen concentration $a_1$ of the low-oxygen gas may be realized by, for example, lowering the mixing ratio of a nitrogen gas to air. Lowering the relative humidity $h_2$ of dry air may be realized by, for example, increasing dehumidification capacity of a dry humidifying machine. After executing such processing, the control device 48 executes the processing in Step S21 and the steps thereafter.

In the case where the oxygen concentration and the relative humidity of the mixed gas acquired in Step S21 are present within the appropriate range PA1 (YES in Step S24), the control device 48 judges in Step S28 whether or not the low-oxygen gas generation device 32 and the dry gas generation device 34 are in excessive operation.

When the low-oxygen gas generation device 32 and the dry gas generation device 34 are not in excessive operation (NO in Step S28), the control device 48 executes the processing in Step S21 and the steps thereafter.

When the low-oxygen gas generation device 32 and the dry gas generation device 34 are in excessive operation (YES in Step S28), the control device 48 increases, in Step S29, at least one of the oxygen concentration $a_1$ of the low-oxygen gas generated by the low-oxygen gas generation device 32 and the relative humidity $h_2$ of the dry air generated by the dry gas generation device 34. In the case of producing a low-oxygen gas by mixing a nitrogen gas with air, increasing the oxygen concentration $a_1$ of the low-oxygen gas may be realized by, for example, increasing the mixing ratio of a nitrogen gas to air. Increasing the relative humidity $h_2$ of the dry air may be realized by, for example, lowering a dehumidification capacity of the dry humidifying machine. After executing such processing, the control device 48 executes the processing in Step S21 and the steps thereafter.

According to the above-described corrosion prevention method, supplying a mixed gas with a low-oxygen gas mixed with air into the cable 16 makes it possible to reduce the oxygen concentration of water adhered to the plurality of wires 161 to thereby suppress the progress of corrosion of the plurality of wires 161 forming the cable 16 while suppressing an excessive reduction in the oxygen concentration of gas (mixed gas) present around each of the wires 161.

In addition, the above corrosion prevention method includes adopting, as a mixed gas to be supplied into the cable 16, a mixture obtained by mixing a low-oxygen gas with dry air generated by dehumidifying easily available air, which enables a mixed gas to be generated at low costs and with ease.

Moreover, the above corrosion prevention method makes it possible to maintain the oxygen concentration of a mixed gas within a predetermined range, thus enabling an expected effect to be stably obtained.

In particular, the above corrosion prevention method includes setting the oxygen concentration of a mixed gas to be 16% or more, which enables the allowable range of the oxygen concentration of the mixed gas to be expanded as much as possible while taking account of influence on a human body (for example, an influence on a worker working in the workroom 123). This enables the control of the oxygen concentration of the mixed gas to be easily performed.

Besides, the above corrosion prevention method, including adjusting not only the oxygen concentration of a mixed gas but also the relative humidity of the mixed gas, makes it possible to further delay the progress of corrosion of the plurality of wires 161.

In particular, according to the above corrosion prevention method, making the oxygen concentration of the mixed gas be lower than the oxygen concentration of air enables the relative humidity allowable range necessary for delaying the progress of corrosion of the plurality of wires 161 to be expanded as indicated by the region surrounded by the point A, the point E, and the point D in FIG. 8.

Although the above relative humidity of the mixed gas can be reduced also by lowering the relative humidity of the low-oxygen gas, lowering the relative humidity of the dry air as in the above corrosion prevention method makes it possible to reduce the above relative humidity of the mixed gas more easily, because the amount of dry air to be used for generating the mixed gas is larger than that of the low-oxygen gas to be used.

Besides, the above corrosion prevention method, including adjusting the relative humidity of dry air and the oxygen concentration of a low-oxygen gas so as to locate the relative humidity of a mixed gas above the curved line C2, makes it possible to suppress excessive reduction in the relative humidity of the mixed gas.

Figure 11:
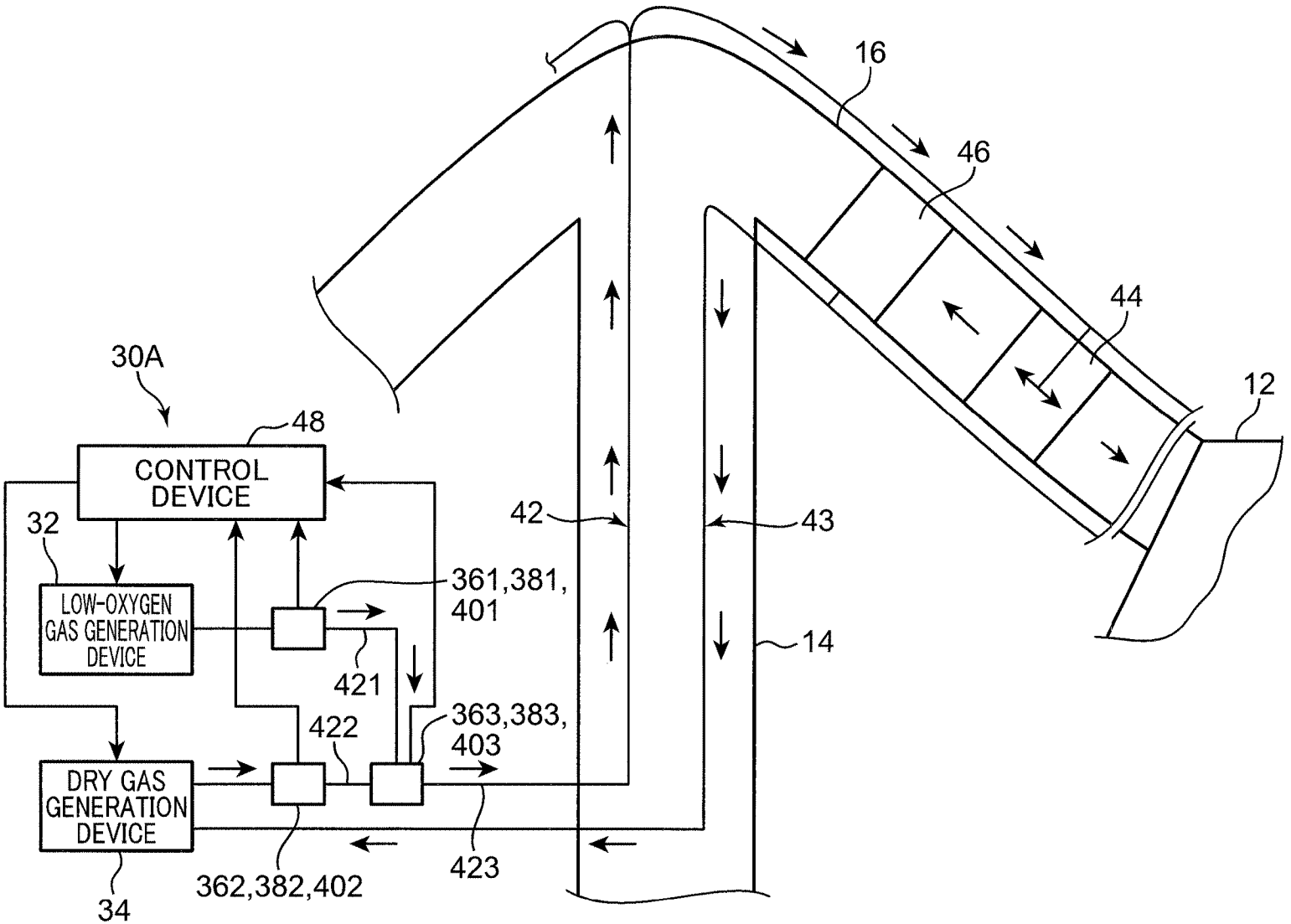
FIG. 11 is a schematic view of a corrosion prevention apparatus adopted in a second embodiment of the present invention.

With reference to FIG. 11, a second embodiment of the present invention will be described. This embodiment adopts a corrosion prevention apparatus 30A in place of the above corrosion prevention apparatus 30. The corrosion prevention apparatus 30A further includes a piping 43 in addition to components equivalent to the components included in the corrosion prevention apparatus 30.

The piping 43 is disposed so as to be capable of collecting a mixed gas (having been already used) discharged from each of a plurality of exhaust covers 46 and supplying the collected mixed gas to the dry gas generation device 34. The piping 43 is connected to an exhaust port 461 provided in each of the exhaust covers 46. The piping 43 includes a portion extending along the cable 16 and a portion positioned internally of each of the main towers 14.

Figure 12:
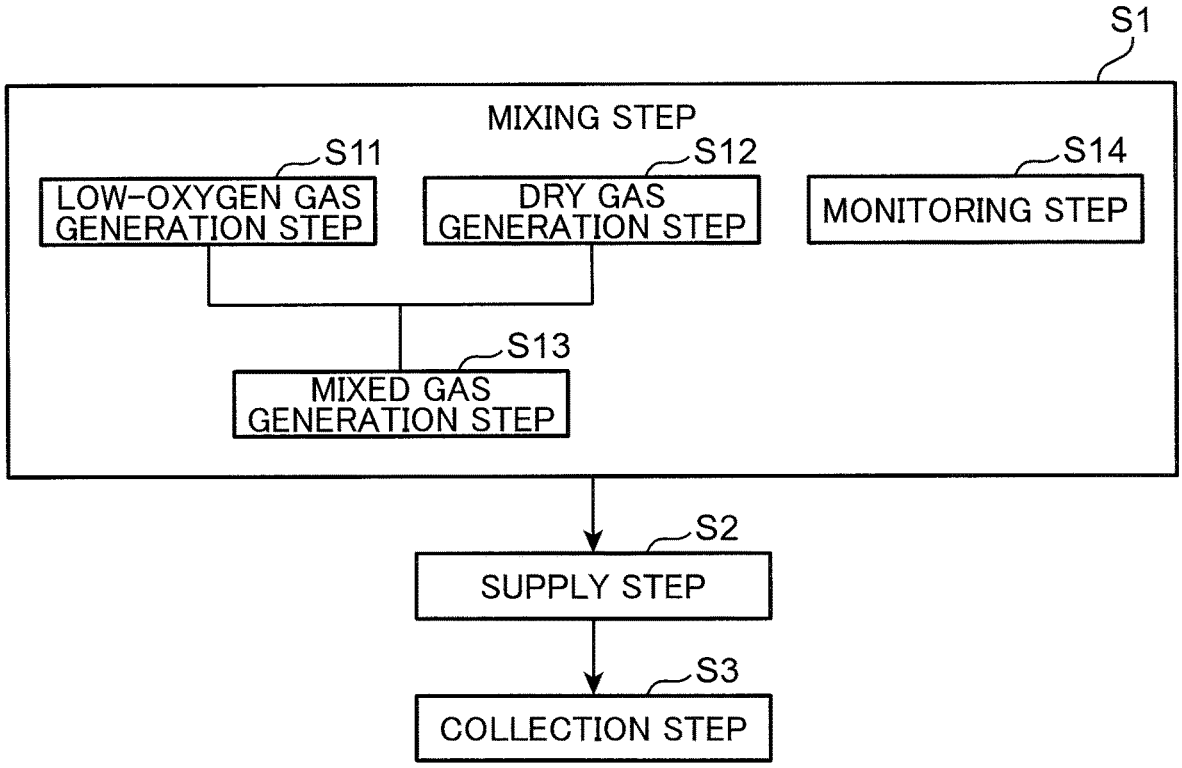
FIG. 12 is a flow chart showing a method for preventing corrosion of a cable according to the second embodiment.

With reference to FIG. 12, a corrosion prevention method in the present embodiment will be described. The corrosion prevention method of the present embodiment further includes a collection step (Step S3) in addition to steps equivalent to the steps included in the corrosion prevention method of the first embodiment. The collection step is a step of collecting a mixed gas (having been already used) discharged from each of the exhaust covers 46 and resupplying the collected mixed gas into the cable 16. Specifically, the collection step is a step of regenerating the used mixed gas through the dry gas generation device 34 and thereafter resupplying the regenerated mixed gas into the cable 16. In the present embodiment, the mixing step (Step S1), the supply step (Step S2), and the collection step (Step S3) are sequentially executed in this order due to the configuration of the corrosion prevention apparatus 30A.

Including supplying a mixed gas having an oxygen concentration lower than that of air into the cable 16, the corrosion prevention method according to the present embodiment allows the same effects as those of the first embodiment to be obtained.

In addition, collecting the used mixed gas and resupplied it into the cable 16 in the present embodiment allows the mixed gas (having been already used) to be used as at least a part of the mixed gas (unused mixed gas) to be flow around each of the wires. This enables the amount of a low-oxygen gas to be used for generating an unused mixed gas to be reduced.

Although the embodiments of the present invention have been detailed in the foregoing, the embodiments are merely examples and the present invention is not construed to be limited by the recitation of the above embodiments.

As described in the foregoing, there is provided a method for preventing corrosion of a cable including a plurality of bundled wires and a covering tube which covers the plurality of wires, the method including: a step of mixing a low-oxygen gas with an air, the low-oxygen gas having an oxygen concentration lower than an oxygen concentration of the air, to thereby generate a mixed gas; and a step of supplying the generated mixed gas into the covering tube to flow the mixed gas around each of the wires.

According to the above corrosion prevention method, flowing a mixed gas generated by mixing a low-oxygen gas with air around each of the wires makes it possible to reduce the oxygen concentration of water adhered to the plurality of wires to thereby suppress the progress of corrosion of the wires while suppressing excessive reduction in the oxygen concentration of the gas (mixed gas).

In addition, the above corrosion prevention method, including the use of a mixed gas obtained by mixing a low-oxygen gas with easily available air which absolutely exists under an environment where human beings live, allows a mixed gas to be generated at low costs and with ease.

In the above corrosion prevention method, the mixed gas generation step preferably includes an oxygen concentration control step of adjusting a mixing ratio of the low-oxygen gas to the air to control the oxygen concentration of the mixed gas so as to maintain the oxygen concentration of the mixed gas within a predetermined range. Thus maintaining the oxygen concentration of the mixed gas within a predetermined range enables the expected effect to be stably obtained.

In the above corrosion prevention method, the oxygen concentration control step preferably includes adjusting the mixing ratio of the low-oxygen gas to the air to make the oxygen concentration of the mixed gas be a value which is set in consideration with influence on a human body. This makes it possible to expand the allowable range of the oxygen concentration of the mixed gas while taking account of influence on a human body. This facilitates the control of the oxygen concentration of a mixed gas.

In the above corrosion prevention method, the mixed gas supply step preferably includes discharging at least a part of the mixed gas having been flowed around each of the wires, from one end of the covering tube opened in the workroom, into a workroom configured to allow a worker to enter the workroom to conduct maintenance of the cable. This makes it possible to form a mixed-gas atmosphere in the workroom to thereby restrain corrosion of the plurality of wires from progressing from a part located in the workroom. Besides, it is also possible to suppress an excessive reduction in the oxygen concentration of a mixed gas to reduce an influence on a worker working in the workroom.

In the above corrosion prevention method, the mixed gas generation step preferably includes a relative humidity setting step of setting a relative humidity of one of the air and the low-oxygen gas to be lower than a relative humidity of the other of the air and the low-oxygen gas, and a control step of adjusting a mixing ratio of the low-oxygen gas to the air to control the relative humidity of the mixed gas so as to maintain the relative humidity of the mixed gas within a predetermined range. This case allows a mixed gas having a relative humidity appropriately set to be flowed flow between the wires, which makes it possible to further delay the progress of corrosion of the plurality of wires. Besides, setting the oxygen concentration of the mixed gas to be lower than the oxygen concentration of the air allows the allowable relative-humidity range necessary for delaying progress of corrosion of the plurality of wires to be expanded.

In the above corrosion prevention method, the relative humidity setting step preferably includes drying the air to reduce the relative humidity of the air to a value lower than a value of the relative humidity of the low-oxygen gas. Thus lowering the relative humidity of air, whose amount to be used is more than that of low-oxygen gas, enables the relative humidity of the mixed gas to be more easily reduced.

In the above corrosion prevention method, the oxygen concentration control step preferably includes a step of measuring the oxygen concentration and the relative humidity of the mixed gas and a step of adjusting at least one of the relative humidity of the air and the oxygen concentration of the low-oxygen gas, when the measured relative humidity is lower than a lower limit value of the relative humidity of the mixed gas, the lower limit value being determined based on the measured oxygen concentration, to thereby make the relative humidity of the mixed gas be higher than the lower limit value. This makes it possible to restrain the relative humidity of the mixed gas from being excessively reduced.

Preferably, the above corrosion prevention method further includes a step of collecting the mixed gas having been flowed around each of the wires from inside the covering tube to reflow the collected mixed gas around each of the wires. This step makes it possible to reduce the amount of a low-oxygen gas to be used for generating the unused mixed gas by use of the collected mixed gas (the mixed gas having been already used) as at least a part of a mixed gas to be flowed around each of the wires (unused mixed gas).

This application is based on Japanese Patent Application No. 2017-225495 filed in Japan Patent Office on Nov. 24, 2017, the contents of which are hereby incorporated by reference.

Although the present invention has been fully described by way of example with reference to the accompanying drawings, it is to be understood that various changes and modification will be apparent to those skilled in the art. Therefore, unless otherwise such changes and modifications depart from the scope of the present invention hereinafter defined, they should be construed as being included therein.

The invention claimed is:

1. A method for preventing corrosion of a cable including a plurality of bundled wires and a covering tube which covers the plurality of wires, the method comprising:

a step of mixing a low-oxygen gas with an air, the low-oxygen gas having an oxygen concentration lower than an oxygen concentration of the air, to thereby generate a mixed gas;

a step of measuring an oxygen concentration of the mixed gas; and a step of supplying the generated mixed gas into the covering tube to flow the mixed gas around each of the wires, and wherein the mixed gas generation step includes an oxygen concentration control step of adjusting a mixing ratio of the low-oxygen gas to the air to control an oxygen concentration of the mixed gas so as to maintain the measured oxygen concentration of the mixed gas within a predetermined range.

2. The corrosion prevention method according to claim 1, wherein the oxygen concentration control step includes adjusting the mixing ratio of the low-oxygen gas to the air to make the oxygen concentration of the mixed gas be a value which is set in consideration with influence on a human body, the value being greater than or equal to 16%.

3. A method for preventing corrosion of a cable including a plurality of bundled wires and a covering tube which covers the plurality of wires, the method comprising:

a step of mixing a low-oxygen gas with an air, the low-oxygen gas having an oxygen concentration lower than an oxygen concentration of the air, to thereby generate a mixed gas; and a step of supplying the generated mixed gas into the covering tube to flow the mixed gas around each of the wires, and wherein the mixed gas supply step includes discharging at least a part of the mixed gas having been flowed around each of the wires, from one end of the covering tube opened in a workroom, into the workroom configured to allow a worker to enter the workroom to conduct maintenance of the cable.

4. A method for preventing corrosion of a cable including a plurality of bundled wires and a covering tube which covers the plurality of wires, the method comprising:

a step of mixing a low-oxygen gas with an air, the low-oxygen gas having an oxygen concentration lower than an oxygen concentration of the air, to thereby generate a mixed gas; and a step of supplying the generated mixed gas into the covering tube to flow the mixed gas around each of the wires, and wherein the mixed gas generation step includes: a relative humidity setting step of setting a relative humidity of one of the air and the low-oxygen gas to be lower than a relative humidity of the other of the air and the low-oxygen gas; and a relative humidity control step of controlling a relative humidity of the mixed gas by adjusting a mixing ratio of the low-oxygen gas to the air so as to maintain the relative humidity of the mixed gas within a predetermined range.

5. The corrosion prevention method according to claim 4, wherein the relative humidity setting step includes drying the air to reduce the relative humidity of the air to a value lower than a value of the relative humidity of the low-oxygen gas.

6. A method for preventing corrosion of a cable including a plurality of bundled wires and a covering tube which covers the plurality of wires, the method comprising:

a step of mixing a low-oxygen gas with an air, the low-oxygen gas having an oxygen concentration lower than an oxygen concentration of the air, to thereby generate a mixed gas; and a step of supplying the generated mixed gas into the covering tube to flow the mixed gas around each of the wires, and wherein the mixed gas generation step includes an oxygen concentration control step of adjusting a mixing ratio of the low-oxygen gas to the air to control an oxygen concentration of the mixed gas so as to maintain the oxygen concentration of the mixed gas within a predetermined range, and wherein the oxygen concentration control step includes: a step of measuring an oxygen concentration and a relative humidity of the mixed gas; and a step of adjusting at least one of the relative humidity of the air and the oxygen concentration of the low-oxygen gas, when the measured relative humidity is lower than a lower limit value of the relative humidity of the mixed gas, the lower limit value being a value of a relative humidity which corresponds to the measured oxygen concentration on a relationship between an oxygen concentration and a relative humidity to make a corrosion progress speed of steel material be a speed lower than a corrosion progress speed in a corrosion limit state of steel material, to thereby make the relative humidity of the mixed gas be higher than the lower limit value.

* * * * *